US005820660A

United States Patent [19]

Ko

[11] Patent Number: 5,820,660

[45] Date of Patent: Oct. 13, 1998

[54] AIR CLEANER HAVING IMPROVED DUST COLLECTOR

[76] Inventor: Li-Sheng Ko, 3/F., No. 245, Jao-Ho St., Taipei City, Taiwan

[21] Appl. No.: 902,212

[22] Filed: Jul. 29, 1997

[51] Int. Cl.[6] ..... B03C 3/74

[52] U.S. Cl. ..... 96/30; 96/81; 96/97

[58] Field of Search ..... 96/80, 55, 57, 96/58, 65, 66, 68, 83, 92, 97, 98, 67, 39, 81, 82, 30; 55/507

[56] References Cited

U.S. PATENT DOCUMENTS

| | | | |
|---|---|---|---|
| 3,073,094 | 1/1963 | Landgraf et al. | 96/66 |
| 4,049,400 | 9/1977 | Bennett et al. | 96/80 |
| 5,055,115 | 10/1991 | Yikai et al. | 96/97 X |
| 5,268,009 | 12/1993 | Thompson et al. | 96/67 |
| 5,290,343 | 3/1994 | Morita et al. | 96/68 X |
| 5,456,741 | 10/1995 | Takahara et al. | 96/67 X |
| 5,622,543 | 4/1997 | Yang | 96/97 X |
| 5,702,507 | 12/1997 | Wang | 96/97 X |

FOREIGN PATENT DOCUMENTS

| | | | |
|---|---|---|---|
| 6-238194 | 8/1994 | Japan | 96/97 |
| 827158 | 2/1960 | United Kingdom | 96/67 |
| 829583 | 3/1960 | United Kingdom | 96/80 |

*Primary Examiner*—Richard L. Chiesa
*Attorney, Agent, or Firm*—Rosenberg, Klein & Bilker

[57] ABSTRACT

An air cleaner having an improved dust collector is provided. The dust collector can be readily removed for cleaning since the dust collector is directly attached to the rear cover of the filter, such that it can be removed together with the rear cover for cleaning. As a result, the rear cover and the dust collector can be removed in a more safe manner, such that an electric shock can be advantageously avoided. The air cleaner is provided with a processing chamber in the rear portion of the housing and an anion generating plate is disposed within the processing chamber. A locking tab and one lead of a power cord are fixedly attached to one side of the anion generating plate. The other end of the locking tab is provided with a hook from which a spring extends. A rear cover is provided to enclose the processing chamber. The rear cover is provided with a plurality of mounting posts by which a dust collector is mounted thereon. When the rear cover is attached to the processing chamber, the anion generating plate can be suitably received within the processing chamber and is biased by the spring disposed within the processing chamber. The housing further includes a substantially circular flange in which a power socket is disposed. An opening in the circular flange is opened toward the processing chamber. By that arrangement, the power plug together with the power cord are routed over the rear cover. In cleaning the dust collector, the plug must be unplugged first and then the rear cover together with the dust collector can be readily removed for cleaning, avoiding an electrical shock hazard.

1 Claim, 3 Drawing Sheets

AIR CLEANER HAVING IMPROVED DUST COLLECTOR

BACKGROUND OF THE INVENTION

1. Field of the Invention

The present invention relates to an air cleaner. More particularly, the present invention is directed to an air cleaner having an improved dust collector. The dust collector can be readily removed for cleaning since the duct collector is directly attached to the rear cover of the filter, such that it can be removed together with the rear cover for cleaning. Furthermore, the rear cover and the dust collector can be removed in a more safe manner such that the electric shock can be advantageously avoided.

2. Prior Art

As shown in FIG. 4, the air cleaner 5 is built with a processing chamber 51 in which an anion generating plate 52 is disposed. The peripheral portion of the anion generating plate 52 is provided with a plurality of studs 53 by which a dust collector 54 is mounted thereon. During the operation of the air cleaner, the air is drawn in from the rear cover 55 of the air cleaner. Then, the air is filtered by the dust collector 54 and is processed by the anion generating plate 52. After the air is cleaned, the fresh air is blown forward by the blower 56 disposed in the front position of the air cleaner. As the air cleaner is operated continuously, the air is circulated and cleaned. However, the conventional air cleaner can still have the following disadvantages which need to be solved.

1. The dust collector must be cleaned on a schedule to ensure the performance of the air cleaner and the quality of air provided. However, in the conventional air cleaner, the dust collector is fixedly and directly locked to the anion generating plate. If the user wants to remove the dust collector for cleaning, he/she must first remove the rear panel and then unlock the locking nuts that are fixedly attached to the mounting posts by which the anion generating plate is mounted. This disassembly process takes a great deal of time.

2. The disassembling procedure is complicated. Normally, the anion generating plate is electrically charged, unless the power cord has been previously unplugged, exposing the consumer to an electric shock. That arrangement is really dangerous to the user.

SUMMARY OF THE INVENTION

It is the objective of this invention to provide an improved dust collector for an air cleaner wherein the dust collector can be readily removed for cleaning. According to one aspect of this invention, the dust collector is directly attached to the rear cover of the filter such that it can be removed together with the rear cover for cleaning. Furthermore, the rear cover and the dust collector can be removed in a more safe manner such that an electric shock can be advantageously avoided.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
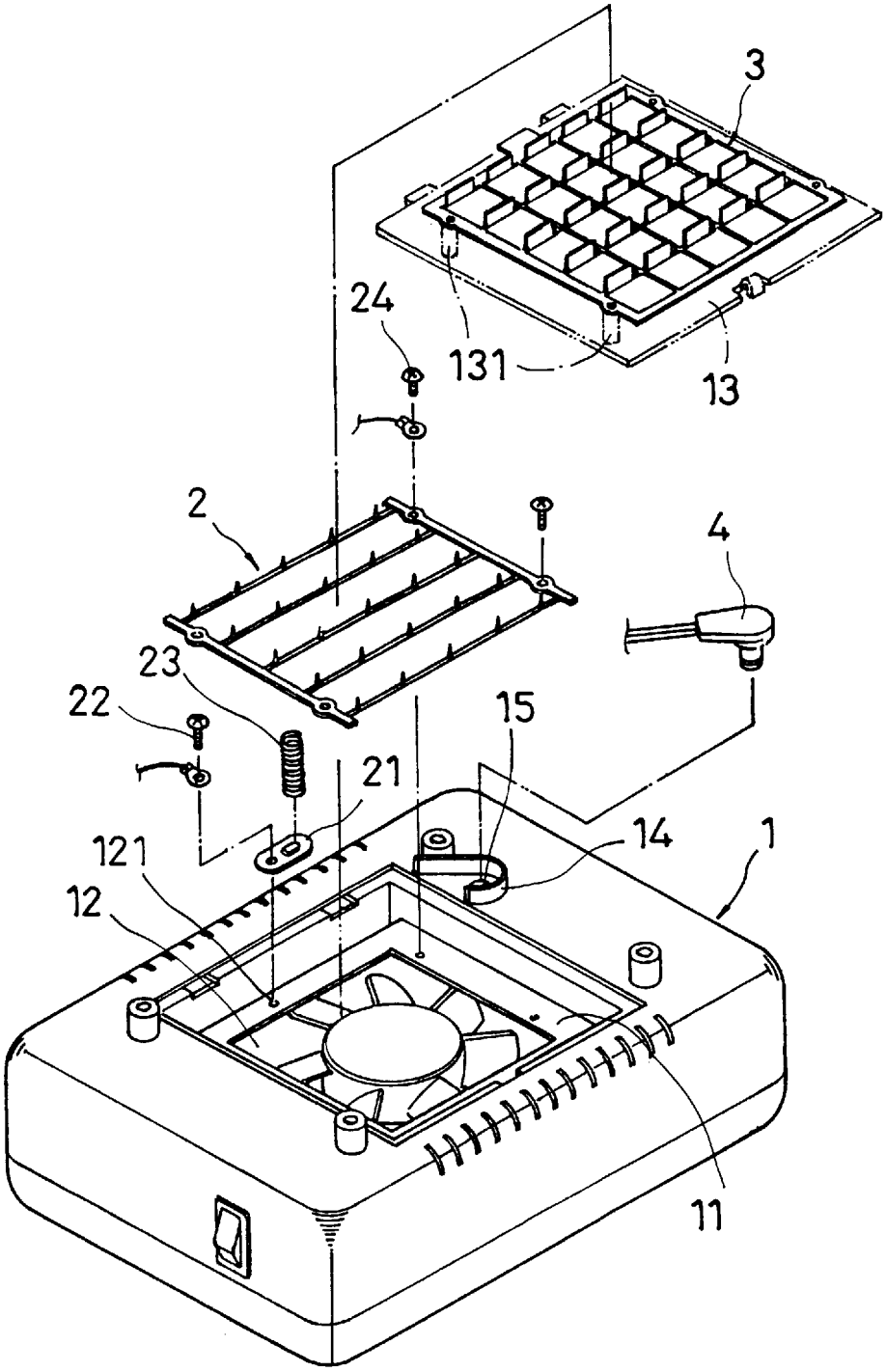
FIG. 1 is a perspective view of the improved dust collector made according to the present invention.
Figure 2:
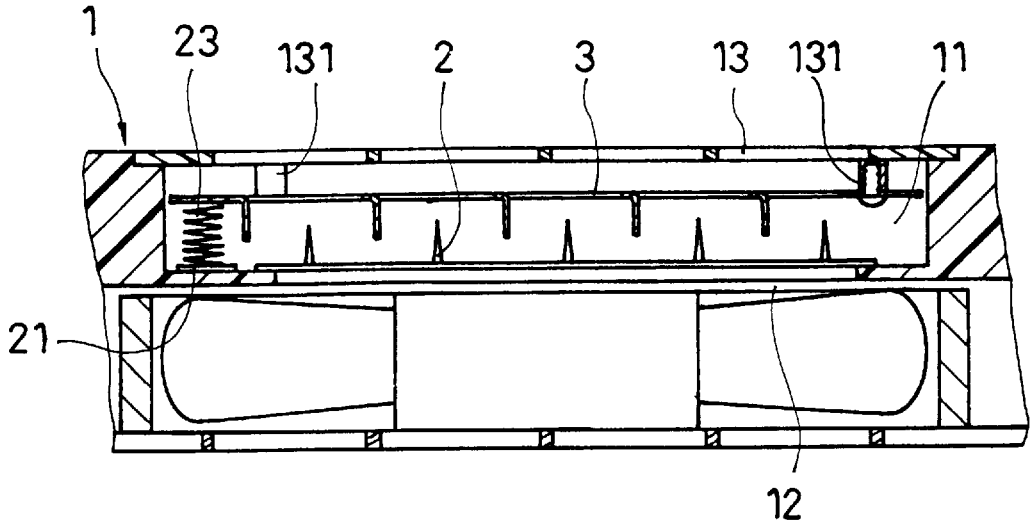
FIG. 2 is a partially enlarged view of the rear cover in which the dust collector is fixedly attached thereof.

Referring to FIGS. 1 and 2, the air cleaner 1 is shown with a removable dust collector 3. The air cleaner 1 includes a processing chamber 11 at the rear portion of the air cleaner 1. The bottom periphery of the processing chamber 11 is provided with threaded air passages 12. The air cleaner 1 is mounted with a blower in the front portion thereof. When the blower is operated, the air can be drawn in from the threaded air passages 12. The processing chamber 11 is further provided with threaded recess 121 disposed adjacent to the threaded air passages 12. A locking tab 21 is disposed above the threaded recess 121 and is provided with an opening corresponding to the threaded recess 121. As a result, a power cord lead can be locked to the threaded recess 121 of the processing chamber 11 together with the locking tab 21 by means of a locking bolt 22. The other end of the locking tab 21 is provided with a hook in which spring 23 is anchored and extends therefrom. An anion processing plate 2 is suitably supported on the top of each of the air passages 12 of the processing chamber 11. The anion processing plate 2 is provided with a hole in which a power cord lead can be attached to the anion processing plate 2 by a locking bolt 24. On the other hand, a rear cover 13 can be readily used to close the processing chamber 11.

The rear cover 13 is provided with a plurality of mounting posts 131 which are directed toward the processing chamber 11. The dust collector 3 can be fixedly attached to those mounting posts 131 of the rear cover 13 by means of locking screws. When the rear cover 13 is attached to the processing chamber 11 together with the dust collector 131 mounted thereon, the dust collector 131 will be biased by the spring 23 of the processing chamber 11. On the other hand, the outer housing of the air cleaner 1 adjacent to the processing chamber 11 is formed with a circular flange 14 which is opened toward the processing chamber 11 and has a substantially circular shape. The housing portion enclosed by the circular flange 14 is provided with a power socket 15 into which a power plug 4 can be plugged in.

When the air cleaner 1 is operated, the untreated air will be drawn in from the rear portion of the air cleaner 1. The air will be filtered first by the dust collector 3, such that ashes within the air can be filtered. The air is further treated by the anion generating plate 2 to remove fungi, molds, debris and odors. Subsequently, the treated air is output by the blower through the air passages 12.

After a period of time, the dust collector 3 must be disassembled for cleaning to ensure a proper operation of the air cleaner as well as the air quality. The dust collector 3 is directly and removably attached to the rear cover 13 and rear cover 13 can be readily disassembled from the processing chamber 11. As a result, when the rear cover 13 is removed, the dust collector 3 can be readily washed and cleaned together with the rear cover 13. By this arrangement, the dust collector 3 can be readily removed without disassembling or touching the anion generating plate 2. An electric shock from the anion generating plate 2 can thereby be avoided.

Figure 3:
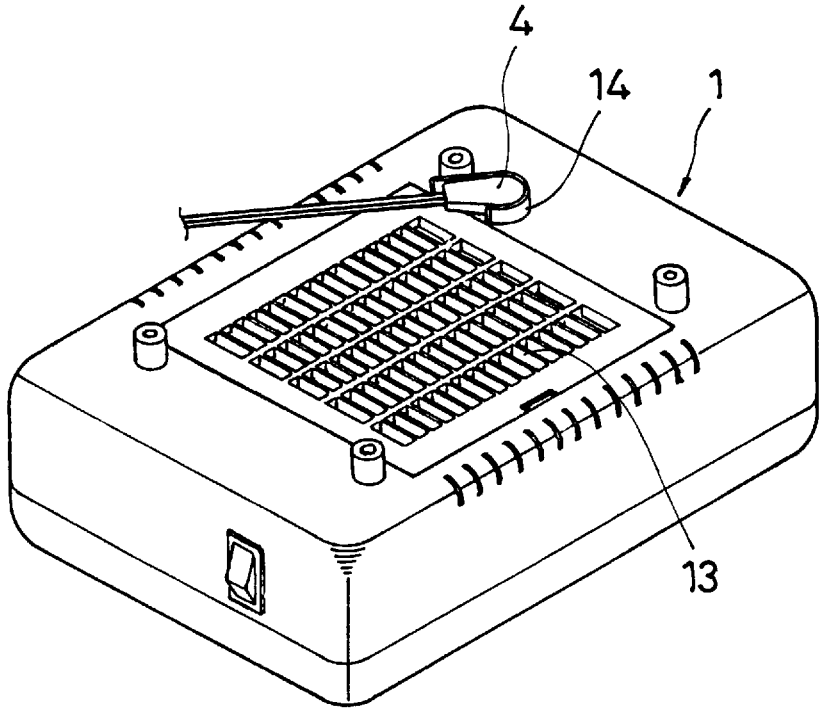
FIG. 3 is a perspective view of the air cleaner in which the power cord is attached to the side portion of the rear cover.
Figure 4:
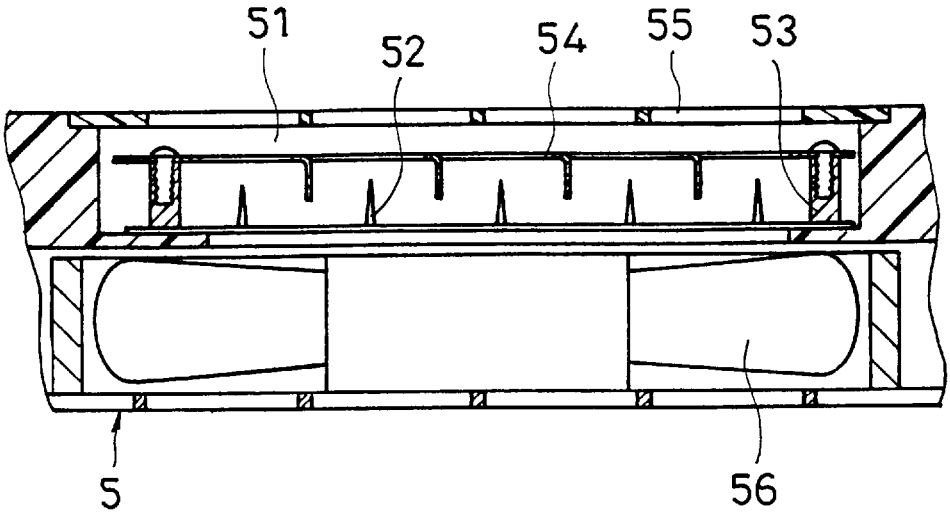
FIG.4 PRIOR ART
FIG. 4 is a side cross-sectional view of the prior art air cleaner.

Referring to FIG. 3, as described above, a substantially circular flange 14 is provided adjacent to the power socket

15 for receiving the power plug 4, and which is opened toward the processing chamber 11. It can be readily appreciated that the power cord is first routed over the processing chamber 11 and the rear cover 13, and then suitably and firmly attached to the power socket 15. As a result, the user must first unplug the power plug 4 from the power socket 15 before the rear cover 13 can be removed. In light of that arrangement, an electrical shock hazard can be completely avoided.

I claim:

1. An air cleaner having an improved dust collector, comprising:

a processing chamber disposed at a rear portion of a housing of said air cleaner and a bottom of said chamber being provided with a plurality of threaded air passages over which an anion generating plate is disposed, said processing chamber having a threaded recess disposed adjacent to said anion generating plate;

a locking tab having a planar shape and being provided with an opening formed on one end thereof disposed over said threaded recess, wherein a power cord lead is locked to said threaded recess of said processing chamber together with said locking tab by means of a locking bolt, an opposing end of said locking tab being provided with a hook in which a spring is anchored and extends therefrom;

a rear cover being tightly closed to said processing chamber and being provided with a plurality of mounting posts extending toward said processing chamber;

a dust collector being received within said processing chamber and fixedly attached to said mounting posts of said rear cover by means of locking screws, said dust collector being suitably biased said spring anchored to said locking tab; and, a substantially circular flange formed on an outer surface of said housing of said air cleaner adjacent to said processing chamber and enclosing a power socket, said flange being open toward said processing chamber for directing a power cord across said rear cover when a power plug is coupled to said power socket, wherein said dust collector is removed together with said rear cover for cleaning subsequent to first unplugging the power plug from said power socket.

* * * * *